US007530137B1

(12) United States Patent
Figueroa et al.

(10) Patent No.: US 7,530,137 B1
(45) Date of Patent: May 12, 2009

(54) APPARATUS FOR APPLYING PAINT ALONG HARD-TO-REACH SURFACES

(76) Inventors: Raul D. Figueroa, 263 W. Ash Ave., Apartment #109, Burbank, CA (US) 91502; Maria Luisa Jimenez, 263 W. Ash Ave., Apartment 109, Burbank, CA (US) 91502

( * ) Notice: Subject to any disclaimer, the term of this patent is extended or adjusted under 35 U.S.C. 154(b) by 743 days.

(21) Appl. No.: 11/129,531

(22) Filed: May 16, 2005

(51) Int. Cl.
*B05C 17/00* (2006.01)

(52) U.S. Cl. ..... 15/210.1; 15/144.2

(58) Field of Classification Search ..... 15/144.2, 15/145, 209.1, 210.1
See application file for complete search history.

(56) References Cited

U.S. PATENT DOCUMENTS 2,395,245 A * 2/1946 Booharin ..... 15/144.2
3,042,952 A * 7/1962 Bradley ..... 15/210.1
3,484,795 A 12/1969 Nocolay
3,599,265 A * 8/1971 D'Ercoli et al. ..... 15/70
3,605,165 A 9/1971 Burns
D249,821 S 10/1978 Cooke et al.
4,219,899 A 9/1980 Zurawin et al.
4,300,258 A * 11/1981 Burns et al. ..... 15/210.1
4,424,603 A * 1/1984 Balint et al. ..... 15/210.1
4,929,112 A * 5/1990 Wilcox ..... 403/93
5,495,635 A 3/1996 Williams
5,802,658 A * 9/1998 Ward ..... 15/144.2
6,530,107 B2 * 3/2003 Kim ..... 15/210.1
6,546,584 B2 4/2003 Hobden
D482,202 S * 11/2003 Newman et al. ..... D4/121
7,028,363 B1 * 4/2006 Gartner ..... 15/210.1
2004/0064909 A1 * 4/2004 Locklear ..... 15/160

* cited by examiner

*Primary Examiner*—Randall Chin

(57) ABSTRACT

An apparatus includes an elongated pole that has opposed proximal and distal ends. The distal end has a threaded outer surface tapered inwardly so that the distal end has a diameter smaller than a diameter of the pole. An applicator section is attachable to the pole and protrudes distally therefrom, and becomes flush with an outer surface of the pole. The applicator section is sized and shaped such that the user can paint an elevated corner surface defined between a wall and an acoustic ceiling while minimizing smearing of paint on the ceiling. Lateral sides of the applicator section are linearly shaped, assisting the user to paint the corner surface without smearing the ceiling. A shielding mechanism, protruding upwardly from the applicator section, shields lateral sides of the applicator section and thereby prevents the painting of ceiling adjoining the corner surface.

15 Claims, 2 Drawing Sheets

APPARATUS FOR APPLYING PAINT ALONG HARD-TO-REACH SURFACES

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to apparatuses for applying paint and, more particularly, to an apparatus for applying paint along hard-to-reach surfaces.

2. Prior Art

When painting wall-like surfaces which abut intersecting surfaces where only one surface is to be painted, it is desirable to utilize an instrument with guide means to keep the other surfaces free of paint. This need is also present when painting other surfaces, such as ceilings, that are abutting another surface that does not require painting, such as walls and ceiling fans. For such purposes painting pads have been developed that are known in the prior art. Unfortunately, such painting pads, although generally sufficient in their function, do have many shortcomings.

An obvious disadvantage of most paint applying apparatuses in the prior art is the limited length of their handles. In the event that a user wishes to paint an area not accessible by simply standing, they are required to employ a ladder or other support surface with the inherent risk of falling. In order to overcome this design flaw, paint applying apparatuses with attachable extensions are known in the prior art.

Even so, some design flaws still exist with regards to such extendable paint applying apparatuses. One example shows a conventional paint pad handle where, once the pad is affixed to the handle, the handle may not be pivotally moved in any direction with respect to the pad. Thus, this design makes is difficult to apply paint evenly on a wall or ceiling when a painter is using the long extension stick.

Accordingly, a need remains for an apparatus for applying paint along hard-to-reach surfaces in order to overcome the above-noted shortcomings. The present invention satisfies such a need by providing a paint applying apparatus that is easy to attach and use, durable and safe in design, adjustable and versatile in use, and results in an improved job quality. Such an apparatus for applying paint along hard-to-reach surfaces has the ability to paint high areas without the use of a ladder, which greatly minimizes the likelihood of falls. The paint applying apparatus is appreciated by both professional commercial painters and do-it-yourself enthusiasts.

BRIEF SUMMARY OF THE INVENTION

In view of the foregoing background, it is therefore an object of the present invention to provide an apparatus for applying paint along hard-to-reach surfaces. These and other objects, features, and advantages of the invention are provided by an apparatus for enabling a user to quickly and efficiently paint a desired surface.

The apparatus includes an elongated and rigid pole that has a centrally disposed longitudinal axis and axially opposed proximal and distal end portions. Such a distal end portion has a threaded outer surface tapered inwardly towards the axis such that the distal end portion has a diameter smaller than a diameter of the rigid pole.

An applicator section is threadably and directly attachable to the pole in such a manner that the applicator section protrudes distally therefrom and becomes flush with an outer surface of the pole. The applicator section is suitably sized and shaped such that the user can conveniently and effectively paint an elevated corner surface defined between a wall and an acoustic ceiling while advantageously minimizing the likelihood of smearing paint on the ceiling. The lateral sides of the applicator section are linearly shaped for conveniently assisting the user to accurately paint the corner surface without smearing the ceiling.

The applicator section preferably includes a female coupling that has a threaded interior surface directly and removably mateable with the distal end portion of the pole. Such a female coupling has a semi-spherical socket monolithically formed at a distal end portion thereof. A ball is operably coupled to the socket in such a manner that the applicator section can effectively be rotatably articulated about an x-axis, a y-axis and a z-axis respectively.

The applicator section may further include an arm that has monolithically formed first and second portions. The first and second portions of the arm preferably have rectilinear shapes. Such a first portion is directly conjoined to the ball and axially protrudes away therefrom. The second section is obliquely offset from the first portion and is directly conjoined to the top surface of the housing in such a manner that the applicator pad can be appropriately angled and continuously abutted against the corner surface during operating conditions. The arm may be formed from steel for providing sufficient reinforcement during repetitive stroking actions.

The applicator section preferably also includes a housing formed from rigid and non-corrosive material. Such a housing has planar top and bottom surfaces and a pair of oppositely facing lip portions monolithically formed therewith. The lip portions face downwardly, terminate beyond the bottom surface, and extend orthogonal to a longitudinal axis of the housing. An applicator pad is suitably sized and shaped for being snuggly interfitted against the bottom surface of the housing such that an outer perimeter of the applicator pad becomes nested with the lip portions and conveniently maintained at a substantially stable position during operating conditions.

A mechanism is included for shielding lateral sides of the applicator section and thereby advantageously preventing the user from undesirably painting a ceiling adjoining the corner surface. Such a shielding mechanism protrudes upwardly from the applicator section and is preferably situated above the lip portions.

The shielding mechanism preferably includes a plurality of cylindrical rubber bumpers directly conjoined to an outer surface of the applicator section. Such rubber bumpers are coextensively shaped and extend parallel to each other along the lateral sides of the applicator section. The rubber bumpers are provided with an arcuate outer surface for effectively facilitating a rolling motion when contacting an adjoining wall. Such rubber bumpers are further suitably sized and shaped wherein the outer surfaces thereof extend beyond the lateral sides of the applicator section and terminate at a predetermined distance away therefrom for advantageously adequately prohibiting the applicator section from contacting the adjoining ceiling. The rubber bumpers may be resiliently compressible for conveniently assisting the user to effectively paint up to the corner surface while providing a resilient force to rebound the applicator section after contacting the ceiling.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

Figure 1:
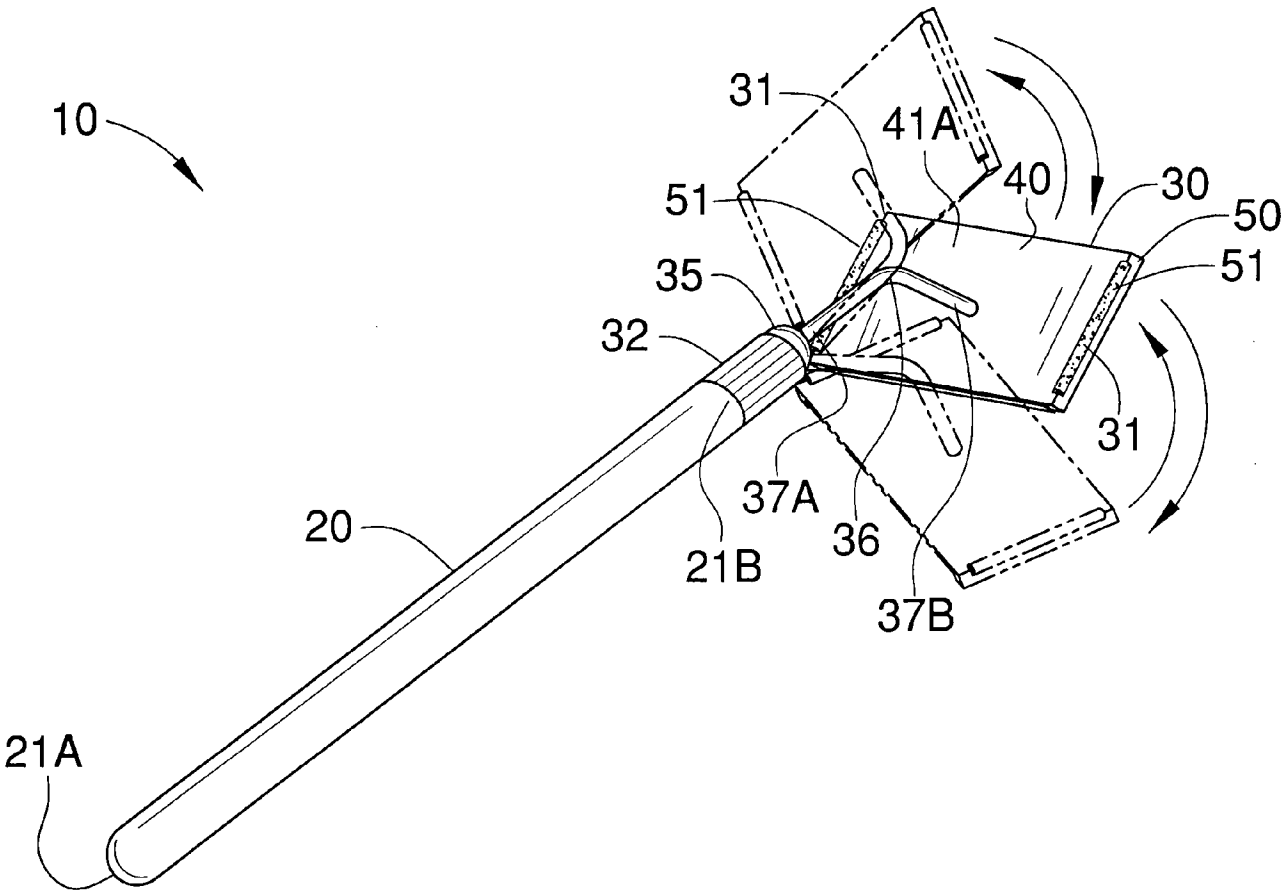
FIG. 1 is a perspective view showing an apparatus for applying paint to hard-to-reach surfaces, in accordance with the present invention.
Figure 2:
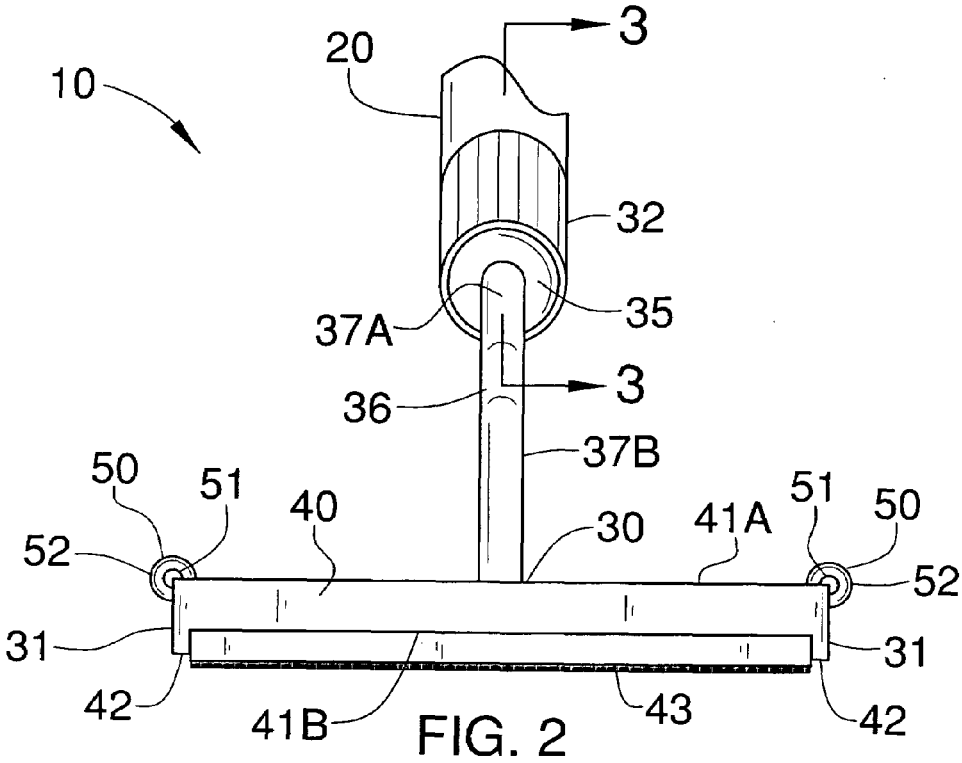
FIG. 2 is an enlarged front-elevational view of the apparatus shown in FIG. 1.
Figure 3:
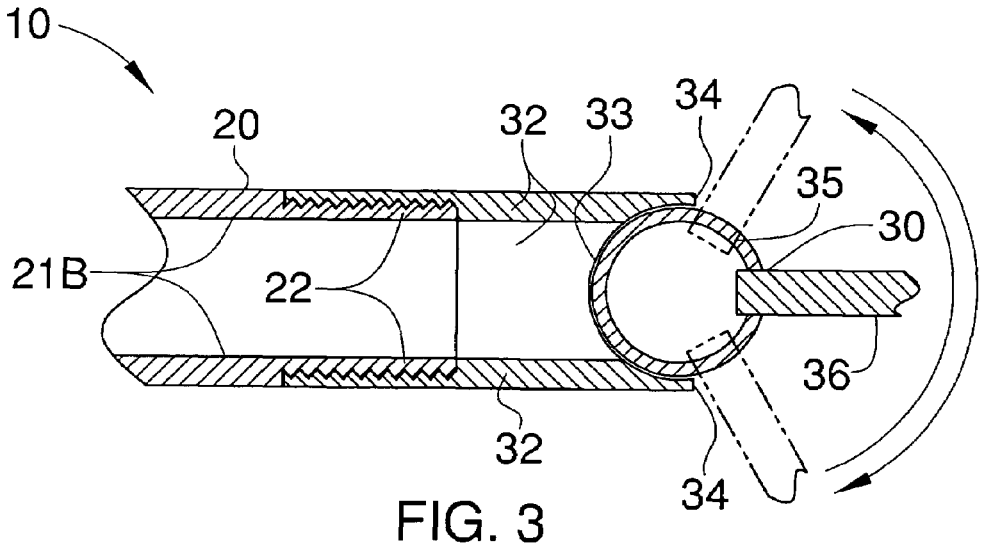
FIG. 3 is a cross-sectional view of the apparatus shown in FIG. 2, taken along line 3-3.

The apparatus of this invention is referred to generally in FIGS. 1-3 by the reference numeral 10 and is intended to provide an apparatus for applying paint to hard-to-reach surfaces. It should be understood that the apparatus 10 may be used to apply paint to many different types of hard to reach surfaces and should not be limited in use to only applying paint to ceilings.

Referring initially to FIG. 1, the apparatus 10 includes an elongated and rigid pole 20 that has a centrally disposed longitudinal axis and axially opposed proximal 21A and distal 21B end portions. Of course, the rigid pole 20 may be produced in a variety of different lengths and sizes, as is obvious to a person of ordinary skill in the art. Such a distal end portion 21B has a threaded outer surface 22 tapered inwardly towards the axis, which is essential such that the distal end portion 21B has a diameter smaller than a diameter of the rigid pole 20.

Referring to FIGS. 1 and 2, an applicator section 30 is threadably and directly attachable, with no intervening elements, to the pole 20 in such a manner that the applicator section 30 protrudes distally therefrom and becomes flush with an outer surface of the pole 20. The applicator section 30 is suitably sized and shaped such that the user can conveniently and effectively paint an elevated corner surface defined between a wall and an acoustic ceiling while advantageously minimizing the likelihood of smearing paint on the ceiling. Of course, the applicator section 30 may be produced in a plethora of alternate shapes and sizes so as to paint a variety of other hard-to-reach surfaces, as is obvious to a person of ordinary skill in the art. The lateral sides 31 of the applicator section 30 are linearly shaped, which is vital and convenient for assisting the user to accurately paint the corner surface without smearing the ceiling.

Referring to FIGS. 1 through 3, the applicator section 30 includes a female coupling 32 that has a threaded interior surface directly and removably mateable, with no intervening elements, with the distal end portion 21B of the pole 20. Such a female coupling 32 has a semi-spherical socket 33 monolithically formed at a distal end portion 34 thereof. A ball 35 is operably coupled, with no intervening elements, to the socket 33 in such a manner that is vital so that the applicator section 30 can effectively be rotatably articulated about an x-axis, a y-axis and a z-axis respectively, as illustrated in FIG. 1. This feature advantageously allows a user to quickly and easily adjust the applicator pad 30 at an angle according to the needs of the painting project.

Still referring to FIGS. 1 through 3, the applicator section 30 further includes an arm 36 that has monolithically formed first 37A and second 37B portions. The first 37A and second 37B portions of the arm 36 have rectilinear shapes. Such a first portion 37A is directly conjoined, with no intervening elements, to the ball 35 and axially protrudes away therefrom.

The second section 37B is obliquely offset from the first portion 37A and is directly conjoined, with no intervening elements, to the top surface 41A of the housing 40 (described herein below) in such a manner that the applicator pad 43 (described herein below) can advantageously be appropriately angled and continuously abutted against the corner surface during operating conditions. This feature is advantageous and vital for allowing the apparatus 10 to apply paint in a smooth manner to the intended surfaces, thus resulting in a finished product of professional appearance.

The arm 36 is formed from steel for providing sufficient reinforcement during repetitive stroking actions. Of course, aluminum or aluminum alloy may be desirable for this purpose because of its characteristic of light weight, as is obvious to a person of ordinary skill in the art. The arm 36 may be polished, chrome plated, nickel plated, or the like, if desirable. Moreover, it is entirely possible that in view of the various kinds and types of plastics now available, the arm 36 may be formed from plastic, as is obvious to a person of ordinary skill in the art.

Referring to FIGS. 1 and 2, the applicator section 30 also includes a housing 40 formed from rigid and non-corrosive material to advantageously ensure that same remains functional after repeated uses. Such a housing 40 has planar top 41A and bottom 41B surfaces and a pair of oppositely facing lip portions 42 monolithically formed therewith. The lip portions 42 face downwardly, terminate beyond the bottom surface 41B, and extend orthogonal to a longitudinal axis of the housing 40.

An applicator pad 43 is suitably sized and shaped for being snuggly interfitted against the bottom surface 41B of the housing 40 such that an outer perimeter of the applicator pad 43 becomes nested with the lip portions 42 and conveniently maintained at a substantially stable position during operating conditions. Of course, such an applicator pad 43 may be produced from a washable material for allowing the repeated use thereof, as is obvious to a person of ordinary skill in the art.

Still referring to FIGS. 1 and 2, a mechanism 50 is included for shielding lateral sides of the applicator section 30 and thereby advantageously preventing the user from undesirably painting ceiling adjoining the corner surface. Such a shielding mechanism 50 protrudes upwardly from the applicator section 30 and is situated above the lip portions 42.

Again referring to FIGS. 1 and 2, the shielding mechanism 50 includes a plurality of cylindrical rubber bumpers 51 directly conjoined, with no intervening elements, to an outer surface of the applicator section 30. Such rubber bumpers 51 are coextensively shaped and extend parallel to each other along the lateral sides of the applicator section 30. Of course, a plurality of rubber bumpers 51 may also be positioned along the longitudinal sides of the applicator section, as is obvious to a person of ordinary skill in the art.

The rubber bumpers 51 are provided with an arcuate outer surface 52 that is essential for effectively facilitating a rolling motion when contacting an adjoining wall. Such rubber bumpers 51 are further suitably sized and shaped wherein the outer surfaces 52 thereof extend beyond the lateral sides of the applicator section 30 and terminate at a predetermined distance away therefrom. This feature is vital and advantageous for adequately prohibiting the applicator section 30 from contacting the adjoining ceiling. The rubber bumpers 51 are resiliently compressible for conveniently assisting the user to effectively paint up to the corner surface while providing a resilient force to rebound the applicator section 30 after contacting the ceiling.

In use, a clean applicator pad 43 is attached to the bottom surface 41B of the housing 40. The applicator section 30 is then adjusted to the appropriate angle according to the needs of the specific painting project and the surfaces to be painted. The applicator pad 43 is subsequently dipped into paint by the user, who may then quickly, easily, smoothly and conveniently apply the paint to the intended surface. Of course, the applicator pad 43 may be used to apply any suitable finishing agent, such as varnish in the case of wood ceilings, as is obvious to a person of ordinary skill in the art.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. An apparatus for enabling a user to quickly and efficiently paint a desired surface, said apparatus comprising:

an elongated and rigid pole having a centrally disposed longitudinal axis and axially opposed proximal and distal end portions, said distal end portion having a threaded outer surface tapered inwardly towards the axis such that said distal end portion has a diameter smaller than a diameter of said rigid pole;

an applicator section threadably and directly attachable to said pole in such a manner that said applicator section protrudes distally therefrom said applicator section being suitably sized and shaped such that the user can effectively paint an elevated corner surface defined between a wall and an acoustic ceiling while minimizing the likelihood of smearing paint on the ceiling; and means for shielding lateral sides of said applicator section and thereby preventing the user from undesirably painting ceiling adjoining the corner surface;

wherein said applicator section comprises a female coupling having a threaded interior surface directly and removably mateable with said distal end portion of said pole, said female coupling having a semi-spherical socket monolithically formed at a distal end portion thereof;

a ball operably coupled to said socket in such a manner that said applicator section can be rotatably articulated about an x-axis, a y-axis and a z-axis respectively;

an arm having monolithically formed first and second portions, said first portion being directly conjoined to said ball and axially protruding away therefrom, said second section being obliquely offset from said first portion;

a housing formed from rigid and non-corrosive material, said housing having planar top and bottom surfaces and a pair of oppositely facing lip portions monolithically formed therewith, said lip portions facing downwardly and terminating beyond said bottom surface and extending orthogonal to a longitudinal axis of said housing; and an applicator pad suitably sized and shaped for being snuggly interfitted against said bottom surface of said housing such that an outer perimeter of said applicator pad becomes nested with said lip portions and maintained at a substantially stable position during operating conditions;

wherein said second portion of said arm is directly conjoined to said top surface of said housing in such a manner that said applicator pad can be appropriately angled and continuously abutted against the corner surface during operating conditions.

2. The apparatus of claim 1, wherein said shielding means comprises:

a plurality of cylindrical rubber bumpers directly conjoined to an outer surface of said applicator section, said rubber bumpers being coextensively shaped and extending parallel to each other along said lateral sides of said applicator section, said rubber bumpers being provided with an arcuate outer surface for facilitating a rolling motion when contacting an adjoining wall, said rubber bumpers being suitably sized and shaped wherein said outer surfaces thereof extend beyond said lateral sides of said applicator section and terminate at a predetermined distance away therefrom for adequately prohibiting said applicator section from contacting the adjoining ceiling.

3. The apparatus of claim 2, wherein said rubber bumpers are resiliently compressible for assisting the user to effectively paint up to the corner surface while providing a resilient force to rebound said applicator section after contacting the ceiling.

4. The apparatus of claim 1, wherein said arm is formed from steel for providing sufficient reinforcement during repetitive stroking actions, each said first and second portions of said arm having rectilinear shapes.

5. The apparatus of claim 1, wherein said shielding means is situated above said lip portions.

6. An apparatus for enabling a user to quickly and efficiently paint a desired surface, said apparatus comprising:

an elongated and rigid pole having a centrally disposed longitudinal axis and axially opposed proximal and distal end portions, said distal end portion having a threaded outer surface tapered inwardly towards the axis such that said distal end portion has a diameter smaller than a diameter of said rigid pole;

an applicator section threadably and directly attachable to said pole in such a manner that said applicator section protrudes distally therefrom, said applicator section being suitably sized and shaped such that the user can effectively paint an elevated corner surface defined between a wall and an acoustic ceiling while minimizing the likelihood of smearing paint on the ceiling; and means for shielding lateral sides of said applicator section and thereby preventing the user from undesirably painting ceiling adjoining the corner surface, wherein said lateral sides of said applicator section are linearly shaped for assisting the user to accurately paint the corner surface without smearing the ceiling;

wherein said applicator section comprises a female coupling having a threaded interior surface directly and removably mateable with said distal end portion of said pole, said female coupling having a semi-spherical socket monolithically formed at a distal end portion thereof;

a ball operably coupled to said socket in such a manner that said applicator section can be rotatable articulated about an x-axis, a y-axis and a z-axis respectively;

an arm having monolithically formed first and second portions, said first portion being directly conjoined to said ball and axially protruding away therefrom, said second section being obliquely offset from said first portion;

a housing formed from rigid and non-corrosive material, said housing having planar top and bottom surfaces and a pair of oppositely facing lip portions monolithically formed therewith, said lip portions facing downwardly and terminating beyond said bottom surface and extending orthogonal to a longitudinal axis of said housing; and an applicator pad suitably sized and shaped for being snuggly interfitted against said bottom surface of said housing such that an outer perimeter of said applicator pad becomes nested with said lip portions and maintained at a substantially stable position during operating conditions;

wherein said second portion of said arm is directly conjoined to said top surface of said housing in such a manner that said applicator pad can be appropriately angled and continuously abutted against the corner surface during operating conditions.

7. The apparatus of claim 6, wherein said shielding means comprises:

a plurality of cylindrical rubber bumpers directly conjoined to an outer surface of said applicator section, said rubber bumpers being coextensively shaped and extending parallel to each other along said lateral sides of said applicator section, said rubber bumpers being provided with an arcuate outer surface for facilitating a rolling motion when contacting an adjoining wall, said rubber bumpers being suitably sized and shaped wherein said outer surfaces thereof extend beyond said lateral sides of said applicator section and terminate at a predetermined distance away therefrom for adequately prohibiting said applicator section from contacting the adjoining ceiling.

8. The apparatus of claim 7, wherein said rubber bumpers are resiliently compressible for assisting the user to effectively paint up to the corner surface while providing a resilient force to rebound said applicator section after contacting the ceiling.

9. The apparatus of claim 6, wherein said arm is formed from steel for providing sufficient reinforcement during repetitive stroking actions, each said first and second portions of said arm having rectilinear shapes.

10. The apparatus of claim 6, wherein said shielding means is situated above said lip portions.

11. An apparatus for enabling a user to quickly and efficiently paint a desired surface, said apparatus comprising:

an elongated and rigid pole having a centrally disposed longitudinal axis and axially opposed proximal and distal end portions, said distal end portion having a threaded outer surface tapered inwardly towards the axis such that said distal end portion has a diameter smaller than a diameter of said rigid pole;

an applicator section threadably and directly attachable to said pole in such a manner that said applicator section protrudes distally therefrom, said applicator section being suitably sized and shaped such that the user can effectively paint an elevated corner surface defined between a wall and an acoustic ceiling while minimizing the likelihood of smearing paint on the ceiling; and means for shielding lateral sides of said applicator section and thereby preventing the user from undesirably painting ceiling adjoining the corner surface, said shielding means protrudes upwardly from said applicator section, wherein said lateral sides of said applicator section are linearly shaped for assisting the user to accurately paint the corner surface without smearing the ceiling;

wherein said applicator section comprises a female coupling having a threaded interior surface directly and removably mateable with said distal end portion of said pole, said female coupling having a semi-spherical socket monolithically formed at a distal end portion thereof;

a ball operably coupled to said socket in such a manner that said applicator section can be rotatably articulated about an x-axis, a y-axis and a z-axis respectively;

an arm having monolithically formed first and second portions, said first portion being directly conjoined to said ball and axially protruding away therefrom, said second section being obliquely offset from said first portion;

a housing formed from rigid and non-corrosive material, said housing having planar top and bottom surfaces and a pair of oppositely facing lip portions monolithically formed therewith, said lip portions facing downwardly and terminating beyond said bottom surface and extending orthogonal to a longitudinal axis of said housings; and an applicator pad suitably sized and shaped for being snuggly interfitted against said bottom surface of said housing such that an outer perimeter of said applicator pad becomes nested with said lip portions and maintained at a substantially stable position during operating conditions;

wherein said second portion of said arm is directly conjoined to said top surface of said housing in such a manner that said applicator pad can be appropriately angled and continuously abutted against the corner surface during operating conditions.

12. The apparatus of claim 11, wherein said shielding means comprises:

a plurality of cylindrical rubber bumpers directly conjoined to an outer surface of said applicator section, said rubber bumpers being coextensively shaped and extending parallel to each other along said lateral sides of said applicator section, said rubber bumpers being provided with an arcuate outer surface for facilitating a rolling motion when contacting an adjoining wall, said rubber bumpers being suitably sized and shaped wherein said outer surfaces thereof extend beyond said lateral sides of said applicator section and terminate at a predetermined distance away therefrom for adequately prohibiting said applicator section from contacting the adjoining ceiling.

13. The apparatus of claim 12, wherein said rubber bumpers are resiliently compressible for assisting the user to effectively paint up to the corner surface while providing a resilient force to rebound said applicator section after contacting the ceiling.

14. The apparatus of claim 11, wherein said arm is formed from steel for providing sufficient reinforcement during repetitive stroking actions, each said first and second portions of said arm having rectilinear shapes.

15. The apparatus of claim 11, wherein said shielding means is situated above said lip portions.

* * * * *